US012654220B2

(12) United States Patent
Michl et al.

(10) Patent No.: US 12,654,220 B2
(45) Date of Patent: Jun. 16, 2026

(54) RING-ROLLING MILL AND METHOD FOR OPERATING SAME

(71) Applicant: SMS group GmbH, Düsseldorf (DE)

(72) Inventors: Dennis Michl, Bochum (DE); Abdelouahed Arrache, Witten (DE); Koos Van Putten, Voerendaal (NL)

(73) Assignee: SMS group GmbH, Düsseldorf (DE)

( * ) Notice: Subject to any disclaimer, the term of this patent is extended or adjusted under 35 U.S.C. 154(b) by 292 days.

(21) Appl. No.: 18/690,091

(22) PCT Filed: Oct. 11, 2022

(86) PCT No.: PCT/EP2022/078220

§ 371 (c)(1),
(2) Date: Mar. 7, 2024

(87) PCT Pub. No.: WO2023/061995

PCT Pub. Date: Apr. 20, 2023

(65) Prior Publication Data

US 2024/0383030 A1 Nov. 21, 2024

(30) Foreign Application Priority Data

Oct. 13, 2021 (DE) ..... 10 2021 211 516.0

(51) Int. Cl.
*B21H 1/06* (2006.01)

(52) U.S. Cl.
CPC ..... *B21H 1/06* (2013.01)

(58) Field of Classification Search
CPC ... B21H 1/06; B21H 1/08; B21H 1/10; B21H 1/12; B21D 53/16
See application file for complete search history.

(56) References Cited

U.S. PATENT DOCUMENTS 2,307,191 A * 1/1943 Bell ..... B21H 1/06 72/87
3,839,887 A * 10/1974 Vieregge ..... B21H 1/06 72/110

(Continued)

FOREIGN PATENT DOCUMENTS

DE 2530519 A1 1/1977
DE 2923001 C2 11/1989

(Continued)

OTHER PUBLICATIONS

Translation of KR-100873305-B1.*

(Continued)

*Primary Examiner* — Bobby Yeonjin Kim
(74) *Attorney, Agent, or Firm* — Smartpat PLC

(57) ABSTRACT

A ring-rolling mill (1) includes a machine table (2) for accommodating the rolled material (3) and an axial stand (4) that supports at least one axial roll, preferably two axial rolls (5, 6), for rolling the end faces (7, 8) of the rolled material (3). The ring-rolling mill and a method for operation thereof facilitate rapid product change without elaborate setting-up or without conversion of the rolling mill. For that purpose at least one pressure roll, preferably two pressure rolls (9, 10), for rolling the outer circumference (11) of the rolled material (3) is further arranged on the axial stand (4). The at least one pressure roll (9, 10) is arranged so as to be translationally displaceable relative to the axial stand (4).

6 Claims, 4 Drawing Sheets

(56) References Cited

U.S. PATENT DOCUMENTS

| | | | | |
|---|---|---|---|---|
| 3,859,830 | A * | 1/1975 | Jeuken | B21H 1/06 72/110 |
| 4,339,937 | A | 7/1982 | Strugala et al. | |
| 2016/0288196 | A1 * | 10/2016 | Iwasa | B21H 1/06 |
| 2020/0306817 | A1 * | 10/2020 | Murai | B21H 1/06 |

FOREIGN PATENT DOCUMENTS

| | | | | |
|---|---|---|---|---|
| JP | S546856 | A | 1/1979 | |
| JP | S5847345 | U | 3/1983 | |
| JP | S632528 | A | 1/1988 | |
| JP | H01157736 | A * | 6/1989 | |
| KR | 100873305 | B1 * | 12/2008 | B21D 22/18 |

OTHER PUBLICATIONS

Translation of JP-H01157736-A.*
Michl, Dennis. Untersuchung des flexiblen axialen Profilierens von nahtlosen Ringen auf Radial-Axial-Ringwalzwerken in Stahl. Shaker, 2009.

* cited by examiner

RING-ROLLING MILL AND METHOD FOR OPERATING SAME

CROSS-REFERENCE TO RELATED APPLICATION

This application is a national stage application, filed under 35 U.S.C. § 371, of International Patent Application PCT/EP2022/078220, filed on Oct. 11, 2022, which claims the benefit of German Patent Application DE 10 2021 211 516.0, filed on Oct. 13, 2021.

TECHNICAL FIELD

The disclosure relates to a ring-rolling mill comprising a machine table for accommodating rolled material and an axial stand that supports at least one axial roll, preferably two axial rolls, for rolling end faces of the rolled material. Furthermore, the disclosure relates to a method for operating such a ring-rolling mill.

BACKGROUND

A ring-rolling mill is generally known from U.S. Pat. No. 2,307,191 It includes an axial stand with rolls for contacting the outer circumference of a ring. However, these are permanently mounted on the axial stand and therefore move together with it in the direction of the machine longitudinal axis.

Thus, an independent displacement of the specified rolls is not possible. Both the radial and axial roll gap are always engaged. The recording of the diameter or ring height is not effected.

SUMMARY

The disclosure further develops a ring-rolling mill of the type mentioned above and a method for its operation in such a way that it is possible to facilitate rapid product change without elaborate setting-up/without conversion of the rolling mill.

This is achieved in that at least one pressure roll, preferably two pressure rolls, is furthermore arranged on the axial stand for rolling the outer circumference of the rolled material, wherein the at least one pressure roll is arranged so as to be translationally displaceable relative to the axial stand.

In most cases, the ring-rolling mill also comprises the usual main roll and a mandrel roll, between which the rolled material can be rolled. Furthermore, centering rolls can also be provided, with which the rolled material can be centered in relation to a longitudinal machine axis.

A preferred further development provides that control and/or regulating means are arranged, with which the at least one pressure roll can be pressed against the rolled material with a specified force or in accordance with a specified translational infeed.

Measuring means with which the outer diameter of the rolled material can be measured can also be arranged on the axial stand. A particularly preferred further development is that the measuring means are formed by the two pressure rolls and a further measuring element. The further measuring element is preferably a roller or a laser measuring device.

Advantageous rolling of the rolled material is facilitated by an embodiment of the invention in such a way that the direction of the translational displacement of the at least one pressure roll and the longitudinal machine axis enclose an angle, wherein the angle is between 0° and 55°, preferably between 25° and 55°.

A further particularly advantageous mode of operation is made possible by the fact that the direction of translational displacement of the at least one pressure roll intersects the longitudinal machine axis at a first point, wherein the at least one axial roll has an axis that intersects the longitudinal machine axis at a second point, wherein the first point is closer to the axial stand than the second point.

The proposed method for operating a ring-rolling mill, comprising a machine table for accommodating the rolled material, a main roll and a mandrel roll, between which the rolled material can be rolled, and an axial stand, which supports at least one axial roll, preferably two axial rolls, for rolling the end faces of the rolled material, is characterized in accordance with the invention in that the rolled material is rolled by means of the at least one axial roll and by means of at least one pressure roll, preferably by means of two pressure rolls, for rolling the end faces of the rolled material, wherein the at least one pressure roll is translationally displaceable relative to the axial stand upon the rolling of the rolled material and wherein the main roll and the mandrel roll do not contact the rolled material upon the rolling of the rolled material.

This procedure can be further developed by the above-mentioned embodiment of the ring-rolling mill.

Thus, an additional device for axially profiled pressure rolling, i.e. for radial-axial ring rolling, is provided for a previously known ring-rolling mill.

With the proposed additional device, an extension of the product range of a ring-rolling mill can be realized. This is a pressure roll device that is mounted in/on the axial stand. In doing so, radially and axially symmetrical and asymmetrical disk/ring products can be produced, by means of combined axial and radial forming in the axial stand. According to a preferred embodiment of the operation of the proposed ring-rolling mill, the radial slide (i.e., the arrangement with the main roll and the mandrel roll for forming the roll gap for the radial rolling of the ring) is not engaged.

The additional device is a combines pressing and ring rolling.

One of the key aspects of the proposed solution is the positioning of the pressure rolls, which reduces the outer wall thickness of the rolled material in its cross-section. Such positioning is effected in particular in a path-force-bound manner, in that the pressure rolls position the rolled material against the flanks of the axial tool, thereby reducing the wall thickness and forming the rolled material.

The two pressure rolls are positioned on the so-called inlet/outlet side of the axial caliber. Based on the independent positioning of the pressure rolls, the rolled material—clamped in the axial caliber (i.e., between the axial rolls)—can be displaced. Such influence has a significant influence on the achievable rolled material geometry.

In addition, it is ensured that the required rolled material dimensions are achieved. For this purpose, the outer diameter of the rolled material is preferably recorded. When the specified diameter value is reached, the forming process is switched off.

With ring-rolling mills, the recording of the diameter is usually effected by measuring the distance between the fixed main roll and the ring position in the axial caliber with the aid of a measuring point (usually by means of a sensing roller or a laser). When using the proposed additional device-in particular with the preferred operation without using the main roll and the mandrel roll-the contact of the rolled material with the main roll cannot be guaranteed. Thus, a different measuring method, which is necessary for the recording of the diameter, is proposed for this. In concrete terms, at least three specific positions on the ring circumference are recorded, two of which are specified by the two pressure rolls; the position of the ring within the axial stand is used as the third signal. The third signal preferably comes from a sensing roller or a laser, which are usually already present in the ring-rolling mill.

Thereby, it is highly advantageous that the proposed ring-rolling mill can continue to be used according to the known prior art upon the deactivation of the additional device.

Thus, the proposed additional device facilitates a rapid product change without elaborate setting-up/without conversion of the machine. The preferred arrangement of the pressure rolls in relation to their direction of displacement relative to the axial stand and in relation to the geometry of the axial rolls facilitates the continuous reduction of the outer wall thickness, through which the forming process takes place. The separate infeed of the pressure rolls facilitates the displacement of the product to increase the quality of the rolled material geometry. Based on the geometry between the direction of displacement of the pressure rolls, the wall thickness of the rolled material can be actively reduced—even without the use of main and mandrel rolls. A displacement of the material clamped in the axial roll gap (i.e., between the two axial rolls) is possible.

The outer diameter can be recorded easily by using a further measuring element in addition to the pressure rolls.

The force required on the pressure rolls can be specified via the process control system.

The proposed solution also makes it possible to partially process rolled material that could not be rolled on previously known ring-rolling mills, i.e. the product range of ring-rolling mills can be extended. Finally, it is possible to change rapidly from one product to another.

DETAILED DESCRIPTION

Figure 1A:
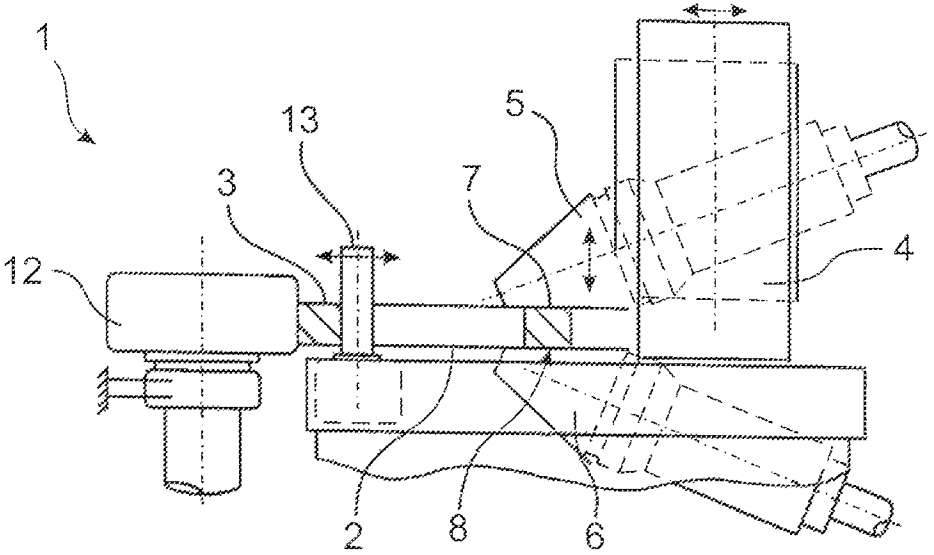
Fig. 1a Prior Art
FIG. 1*a* is a side view of a ring-rolling mill according to the prior art.
Figure 1B:
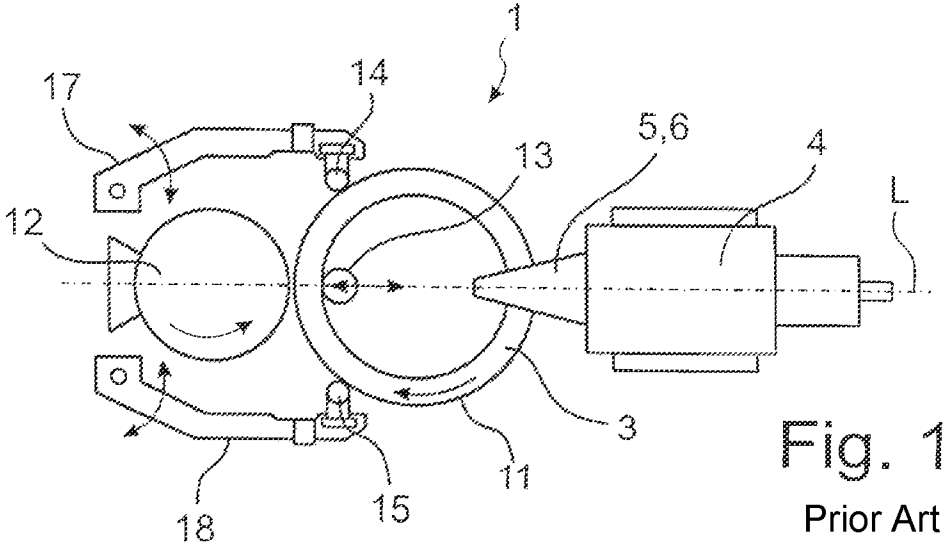
Fig. 1b Prior Art
FIG. 1*b* is a top view thereof.

FIG. 1 shows a solution according to the prior art. The ring-rolling mill 1 has a machine table 2 on which the rolled material 3 is placed in the form of a ring to be rolled. The radial rolling of the ring 3 is effected by a main roll 12, which interacts with a mandrel roll 13. The axial rolling of the ring 3 is effected axially by means of two axial rolls 5 and 6, which are mounted in an axial stand 4. Accordingly, the outer circumference 11 of the rolled material is rolled by the main roll 12, while the end faces 7 and 8 of the rolled material are rolled by the two axial rolls 5 and 6. Centering rolls 14 and 15 are also provided, which are arranged on centering arms 17/18 respectively and with which the rolled material 3 is centered in relation to a longitudinal machine axis L.

Figure 2:
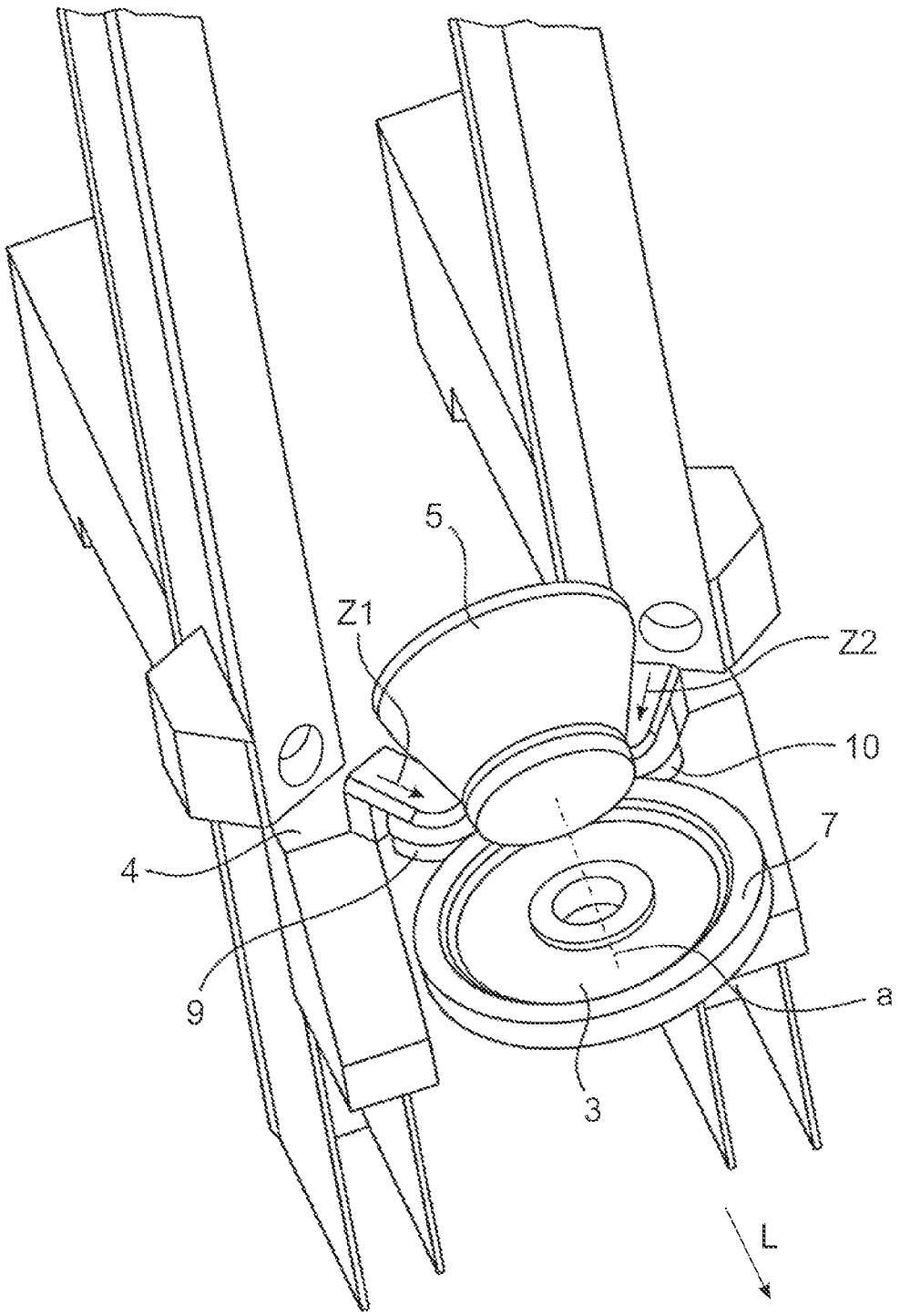
FIG. 2 is a schematic perspective view showing an axial stand of a ring-rolling mill in accordance with one embodiment, with which two pressure rolls are arranged displaceably in/on the axial stand.

With a view to FIG. 2, it can be seen that, in contrast to the aforementioned previously known solution, (preferably two) pressure rolls 9 and 10 are now also arranged on the axial stand 4, which are used to roll the outer circumference 11 of the rolled material 3. It is important to note that the pressure rolls 9 and 10 can be arranged in a translationally displaceable manner relative to the axial stand 4. The translational infeed with which the pressure rolls 9/10 are moved relative to the axial stand is marked Z1 and Z2 in FIG. 2.

Figure 3:
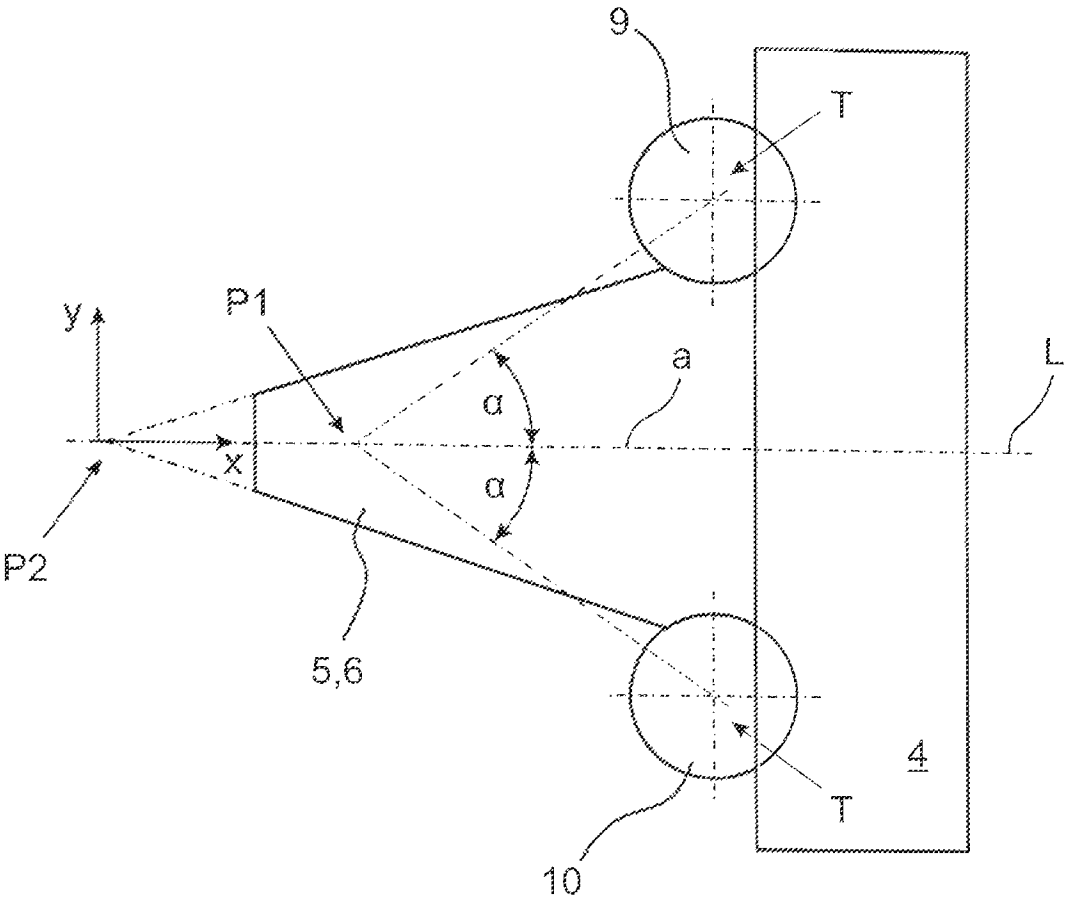
FIG. 3 is a schematic top view of the axial stand in accordance with FIG. 2 with the representation of relevant geometric parameters.
Figure 4:
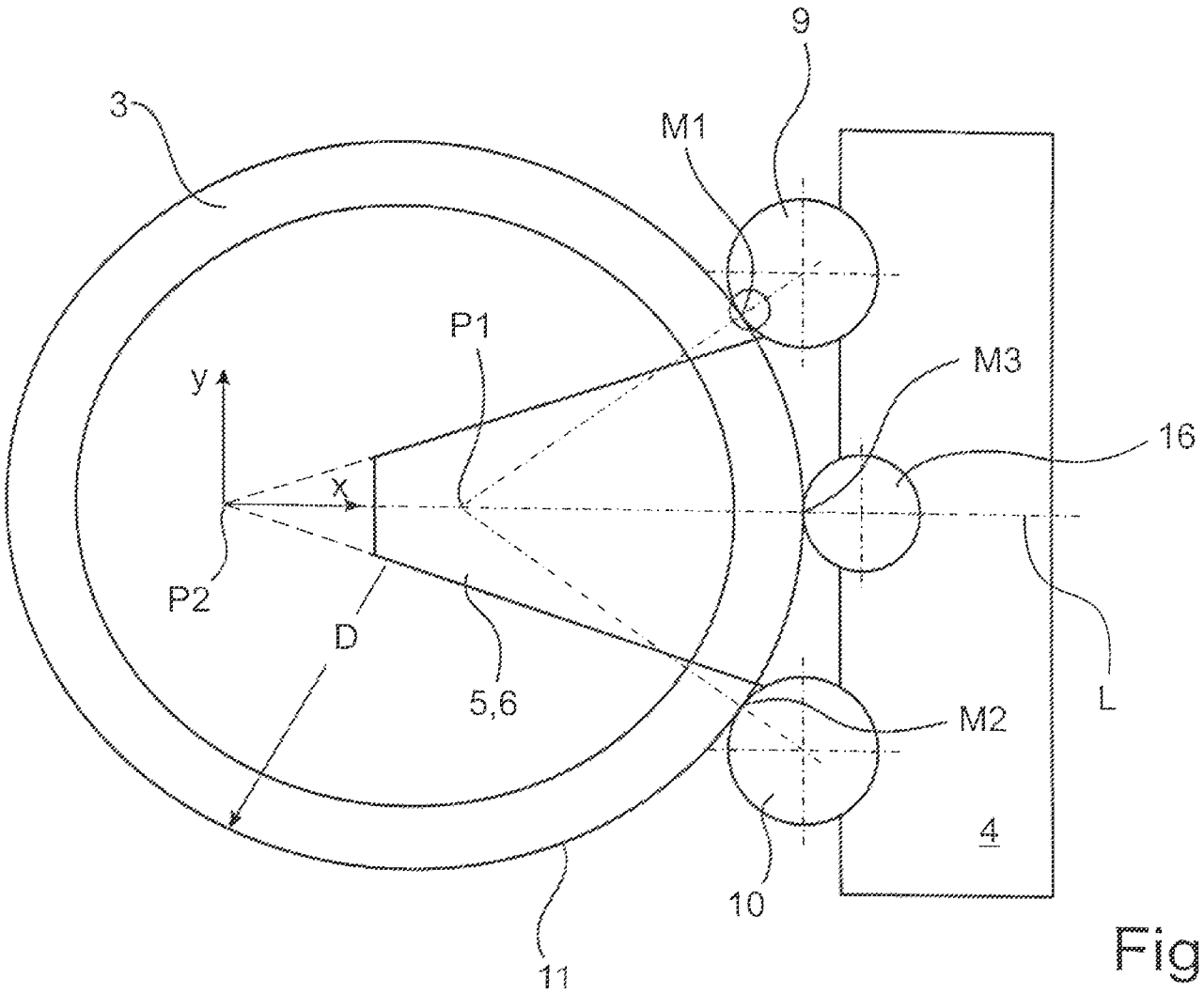
FIG. 4 is a schematic top view of the axial stand in accordance with FIG. 2 showing a measuring arrangement for determining the external diameter of the rolled material.

For this purpose, FIG. 3 illustrates which geometric ratios are particularly preferably proposed in order to achieve rolling of the rolled material 3 and thereby reduce the range of the wall thickness of the rolled material 3 in such a way that an elongation of the cross-section is obtained, which leads to an increase in the outer diameter D (see FIG. 4).

As can be seen in FIG. 3 (top view), the axial stand 4 supports the axial rolls 5/6 along with the two pressure rolls 9 and 10, which in each case are displaced in a translational direction T relative to the axial stand 4 (this is effected by means of actuators, which are not shown). The direction of the axis a of the axial rolls 5, 6 coincides with the longitudinal machine axis L in the top view.

In the top view, the direction T encloses an angle a with the machine longitudinal axis L, which is approximately 35° in the exemplary embodiment. Preferred values for the angle a are between 25° and 55°. The intersection point between the direction T and the longitudinal machine axis L is shown as the first point P1 in FIG. 3.

If the axis a of the axial rolls 5/6 is intersected with the longitudinal machine axis L, a second point P2 is obtained.

Thereby, it is preferably provided that the first point PI is closer to the axial stand 4 than the second point P2.

Thus, the arrangement of the pressure rolls 9, 10 is provided outside the machine longitudinal axis L. The angle $\alpha$ between the direction T and the machine longitudinal axis L is a substantial parameter upon the rolling of the ring. A further relevant parameter is the relative position between the first point Pl and the second point P2 in relation to the axial stand 4. If this is effected as described and as shown in FIG. 3, the continuous feeding of the pressure rolls 9, 10 can be effected in the direction T against the ring cross-section. As a result, the wall thickness of the rolled material can be reduced, with the result that elongation of the cross-section leads to an increase in diameter.

The rolling of the ring is interrupted as soon as a desired outer diameter D of the rolled material 3 is reached. Reference is made to FIG. 4 for the relevant measurement.

It can be seen here that, due to the concept, the two pressure rolls 9 and 10 are in contact with the outer circumference 11 of the rolled material 3 during the rolling process and, as a result of the known geometry of the pressure rolls 9, 10, a first measuring point M1 and a second measuring point M2 are therefore constantly known during the rolling process. FIG. 4 also shows that there is a further measuring element 16, here in the form of a measuring roller, with which a third measuring point M3 can be recorded. Knowing the three measuring points M1, M2 and M3, the outer diameter D of the (circular) rolled material can thus be easily determined.

If a raw part of the rolled material 3 is to be rolled from an initial diameter to an enlarged outside diameter D, the geometric arrangement described, based on the aforementioned range for the angle a and for the relative position of the two points P1 and P2 with respect to the axial stand 4, allows an increasing ring diameter to be achieved with an infeed Z1/Z2 (see FIG. 2) and thus with decreasing x-values for the two pressure rolls 9, 10 (see the coordinate system in FIGS. 3 and 4); thus, the wall thickness of the ring is reduced and ring growth can take place.

If the geometric ratios explained were not observed, there would be no growth in the outer diameter D with an infeed Z1/Z2 in the direction shown in FIG. 2, i.e. with decreasing x-values for the two pressure rolls 9 and 10. Therefore, the geometric relationships/parameters described above are of particular importance in the event that the specified ring growth is desired/required. Accordingly, the pressure rolls 9, 10 thereby can be fed continuously in the direction of the infeed Z1, Z2, while at the same time the outer diameter D of the rolled material 3 increases.

This applies in particular to the preferred procedure, according to which the main roll 12 and the mandrel roll 13 are not engaged, i.e. do not contact the rolled material.

As a function of the size of the ring-rolling mill, the pressure rolls can be arranged on the side walls of the axial stand, or alternatively between the side walls or outside them.

List of Reference Signs

1 Ring-rolling mill
2 Machine table
3 Rolled material (ring)
4 Axial stand
5 Axial roll
6 Axial roll
7 End face of the rolled material
8 End face of the rolled material
9 Pressure roll
10 Pressure roll
11 Outer circumference of the rolled material
12 Main roll
13 Mandrel roll
14 Centering roll
15 Centering roll
16 Measuring element
17 Centering arm
18 Centering arm
L Longitudinal machine axis
T Direction of the translational displacement of the pressure roll
Z1 Translational infeed
Z2 Translational infeed
α Angle
a Axis of the axial roll
P1 First point
P2 Second point
D Outer diameter of the rolled material
M1 Measuring point
M2 Measuring point
M3 Measuring point

The invention claimed is:

1. A ring-rolling mill (1), comprising:
a machine table (2) for accommodating rolled material (3);
an axial stand (4);
two axial rolls (5, 6), supported by the axial stand (4), for rolling end faces (7, 8) of the rolled material (3);
two pressure rolls (9, 10), for rolling an outer circumference (11) of the rolled material (3) also arranged on the axial stand (4), wherein the two pressure rolls (9, 10) are translationally displaceable relative to the axial stand (4);
and
measuring means (9, 10, 16) arranged on the axial stand (4) with which an outer diameter of the rolled material (3) can be measured, the measuring means (9, 10, 16) being formed by the two pressure rolls (9, 10) and a further measuring element (16).

2. The ring-rolling mill according to claim 1, further comprising
a main roll (12) and a mandrel roll (13), between which the rolled material (3) can be rolled.

3. The ring-rolling mill according to claim 1, further comprising
centering rolls (14, 15) with which the rolled material (3) can be centered in relation to a machine longitudinal axis (L).

4. The ring-rolling mill according to claim 1, further comprising
an open or closed-loop control with which the two pressure rolls (9, 10) can be pressed against the rolled material (3) with a specified force or in accordance with a specified translational infeed.

5. The ring-rolling mill according to claim 1,
wherein the further measuring element (16) is a roller or a laser measuring device.

6. The ring-rolling mill according to claim 1,
wherein a direction (T) of translational displacement of each of the two pressure rolls (9, 10) and a machine longitudinal axis (L) enclose an angle (α) between 25° and 55°,
wherein the direction (T) of the translational displacement of each of the two pressure rolls (9, 10) intersects the machine longitudinal axis (L) at a first point (P1), and
wherein each of the two axial rolls (5, 6) has an axis (a) that intersects the machine longitudinal axis (L) at a second point (P2), wherein the first point (P1) is closer to the axial stand (4) than the second point (P2).

* * * * *